US008720430B2

(12) United States Patent
Schuecker et al.

(10) Patent No.: US 8,720,430 B2
(45) Date of Patent: May 13, 2014

(54) MECHANISM FOR THE AUTONOMOUS LATCHING OF COKE OVEN CHAMBER DOORS FOR HORIZONTAL COKE OVEN CHAMBERS

(75) Inventors: Franz-Josef Schuecker, Castrop-Rauxel (DE); Peter Thomas, Erkelenz (DE)

(73) Assignee: Uhde GmbH, Dortmund (DE)

( * ) Notice: Subject to any disclaimer, the term of this patent is extended or adjusted under 35 U.S.C. 154(b) by 820 days.

(21) Appl. No.: 12/734,831

(22) PCT Filed: Nov. 13, 2008

(86) PCT No.: PCT/EP2008/009565

§ 371 (c)(1), (2), (4) Date: Oct. 13, 2010

(87) PCT Pub. No.: WO2009/068184

PCT Pub. Date: Jun. 4, 2009

(65) Prior Publication Data

US 2011/0023860 A1 Feb. 3, 2011

(30) Foreign Application Priority Data

Nov. 27, 2007 (DE) ..... 10 2007 057 410

(51) Int. Cl.
*F23M 7/00* (2006.01)

(52) U.S. Cl.
USPC ..... 126/197; 126/192; 110/173 R

(58) Field of Classification Search
USPC ..... 126/190, 192, 197, 287; 110/173 R, 110/158; 49/324
See application file for complete search history.

(56) References Cited

U.S. PATENT DOCUMENTS

| | | | | |
|---|---|---|---|---|
| 312,578 | A * | 2/1885 | Nightengale | 110/173 R |
| 2,784,849 | A * | 3/1957 | Gillott | 414/684.3 |
| 2,796,995 | A * | 6/1957 | Van Ackeren et al. | 414/684.3 |
| 3,605,155 | A * | 9/1971 | McCullough et al. | 15/93.2 |

(Continued)

FOREIGN PATENT DOCUMENTS

| | | | |
|---|---|---|---|
| DE | 1214646 B | * | 4/1966 |
| DE | 3307844 A1 | * | 9/1984 |

(Continued)

*Primary Examiner* — Craig Schneider
*Assistant Examiner* — Jessica Cahill
(74) *Attorney, Agent, or Firm* — Marshall & Melhorn, LLC

(57) ABSTRACT

A device for latching of horizontal coke oven chambers which is triggered by an auxiliary frame located on the coke oven chamber door is provided. The auxiliary frame is restrictively movable in vertical direction on the coke oven chamber door. During the outward movement, the auxiliary frame hits upwardly against limit stop cams firmly mounted on the oven door and transmitting the vertical traction force onto the coke oven chamber door. During the upward movement, the auxiliary frame actuates levers which are rotationally movable to an axis arranged orthogonally to the coke oven chamber and which are connected to a translatorily freely movable latch. On actuation of this lever, it pulls the latch from the latch take-up bearings mounted on the coke oven chamber door so that the coke oven chamber door is unlatched and opened. In an embodiment of the present invention, the coke oven chamber door can be arrested the open or closed position with a device suitable for this purpose.

12 Claims, 5 Drawing Sheets

(56) References Cited

U.S. PATENT DOCUMENTS

| | | | | | |
|---|---|---|---|---|---|
| 3,831,580 | A | * | 8/1974 | McLean | 126/197 |
| 4,189,352 | A | * | 2/1980 | Stanke | 202/248 |
| 4,532,010 | A | | 7/1985 | Durslen et al. | |
| 5,556,515 | A | * | 9/1996 | Giunta et al. | 202/248 |
| 5,658,434 | A | | 8/1997 | Schlosser | |
| 5,928,476 | A | | 7/1999 | Daniels | |
| 7,331,298 | B2 | | 2/2008 | Barkdoll et al. | |

FOREIGN PATENT DOCUMENTS

| | | | | |
|---|---|---|---|---|
| DE | 10154785 | A1 | * | 5/2003 |
| EP | 0724007 | B1 | * | 1/1999 |
| GB | 929161 | | * | 6/1963 |
| WO | WO 2006028805 | A2 | * | 3/2006 |

* cited by examiner

MECHANISM FOR THE AUTONOMOUS LATCHING OF COKE OVEN CHAMBER DOORS FOR HORIZONTAL COKE OVEN CHAMBERS

BACKGROUND OF THE INVENTION

The present invention relates to a mechanism as a device for latching of doors, door jambs or door bodies of horizontal coke oven chambers. The latching device is unlocked by the vertical traction force of rope tackles or chains and hence it requires no manual or automatic external driving and controlling device. The inventive latching device is insensitive to contamination and pollution like the one typically occurring on modern cokemaking facilities. The inventive latching device also closes coke oven chambers tightly to safely bulkhead high pressure differences between coke oven chamber and environment, thus preventing an escape of cokemaking process by-products harmful to the environment. The inventive latching device locks coke oven chambers even autonomously and thus it requires little maintenance and it is easy to operate.

Coal carbonization processes are run in horizontally charged coke oven chambers, for example, which are charged with a suitable coal to perform the cokemaking process and which are emptied and cleaned by suitable devices upon completion of the carbonization process. To this effect there are door openings on either side of the coke oven chamber in customary structures by way of which the oven is pushed by a suitable device on discharging it from one side to the other. Discharging is usually effected into coke batch cars into which the hot coke is discharged and transported to a quenching facility where the coke push is cooled and cleaned. Structures which allow for charging coke through the coke oven chamber top are also found frequently. The discharging and cleaning process is then realized through the horizontal coke oven chamber openings.

However, with all these structures, the coke oven chamber openings are closed after charging so that the coke oven chambers can be heated and pressurized. During the coal carbonization process, gaseous and vaporous products which are comprised of gases and tarry condensates evolve in the interior of the coke oven chamber. With a so-called "conventional" coke oven, these gases and tarry condensates are collected and passed on to further processing. In these cases, heating of the coke oven chambers is mostly realized from outside. Other types of construction, so-called "Non-Recovery" type coke ovens, utilize coal by-products for combustion, thus generating the heat needed for coal carbonization. "Heat Recovery" ovens, in turn, utilize the heat of combustion from coking gases by secondary facilities.

In both construction styles, the coal carbonization process frequently leads to a pressure build-up in the chamber-type coke oven which needs to be sealed towards the exterior. Since the door structure of the coke oven chamber is exposed to substantial heat impacts, this sealing is difficult to achieve because the coke oven chamber doors suffer from deformation during long operation life and therefore they do not close reliably on a permanent basis. Hence coal by-products are pressed out from the coke oven chamber in form of emissions which represent a substantial hazard to environment and operating staff. Moreover, leakages and fugitives frequently cause encrustation on external walls and doors which are hard to remove and which entail substantial expenditure on cleaning and maintenance of coke oven chambers. For this reason, the doors of coke oven chambers must be sealed and locked as tightly as possible during operation.

Therefore, a great deal of door construction styles is so configured that the actual door is comprised of a so-called plug which presses the contents of a coke oven into the oven chamber and which is retained in position by a frame. Such a plug may have a length of a few millimeters up to several decimeters and usually it is comprised of a refractory material like ceramics or fireclay. For opening and closing, the frame in which the plug is suspended is moved out from the door opening and run into a position of rest. Frequently, these plugs do have a substantial weight which is the reason why frames and suspensions are sometimes hard to insert into the envisaged closing position.

Owing to the high temperature during the coal carbonization process, the doors may become deformed so that they do not seal the coke oven chamber tightly. Moreover, the load-bearing frame structure is exposed to substantial strains and stresses during operation due to the heavy weight. To achieve a reliable sealing of the coke oven chamber interior, the door must therefore be firmly sealed and locked against the coke oven chamber wall. Therefore, the latches which tightly lock the coke oven chamber door versus the environment and keep them in the locked position against the inner pressure of the coke oven chamber are of substantial importance for the design and construction of a coke oven chamber.

Various types of construction have been proposed for the latching of coke oven chamber doors. DE 1214646 B describes a door for horizontal coke oven chambers comprised of latch hooks mounted at the oven body which proceeding from the coke oven chamber wall protrude laterally into the profile of the door and which accommodate supporting levers which are mounted on the front side to the oven door. The supporting levers are adjustable at the coke oven chamber door so as to ensure even pressing if the door has been properly adjusted. By latching the door from the front side, however, the door requires very tightly locking sealing edge devices on the sides of the door frame. Moreover, automation is only difficult to implement because the latching mechanism extends over the entire door device.

DE 3307844 A1 discloses a door device for coke oven chambers which employs a torsionally flexible door to close coke oven chambers and which compensates for deformation forces by a tightly closing sealing edge device and helically closing door latches arranged in front of the door. The ratio between door body stiffness and specific sealing edge force is kept as low as required so as to compensate for the door body deformation mainly by the locking forces and the sealing edge force. The latch bar itself is configured as a revolving lock mounted on the front side of a coke oven chamber door and pressed against a bolt mounted on the chamber frame. Each door is preferably equipped with two latch bars, but depending on deformation forces and on the door height, three latch bars may also be provided for. The sealing edge frame is elastically suspended and pressed by a resilient facility onto the chamber frame so as to constantly seal the gap existing between door and frame. The type of construction described bears a drawback in that the sealing edge frames frequently have to be reworked to ensure tight sealing, thus entailing high expenditure on maintenance. Moreover, the latching mechanism is only hard to handle and difficult to automatize.

Coke oven chambers are usually arranged in coke oven batteries or coke oven banks. Latch bars implemented on a coke oven chamber should seal the doors of the individual coke oven chambers as tightly as possible. They should lock the door firmly and snapped-in versus the coke oven chamber while being easy to handle at the same time. To minimize mechanical expenditure on the latching, it is an advantage to execute the latching mechanism simultaneously with the procedure of opening and closing. Finally, the latching mechanism should be as insensitive as possible to contamination and not get stuck by carbonization products. Besides, the latching mechanism should not excessively increase the weight of a coke oven chamber door. Another requirement exacted from the latching procedure is its capability of being easy to automatize so as to allow it to be actuated by an electrical or electronic control. It is the object to provide a latching mechanism that meets these properties. It is also an object of the invention to provide a method for a vertical opening and latching of doors, door bodies or door jambs of horizontal coke oven chambers. The method should also be autonomous by demand.

BRIEF SUMMARY OF THE INVENTION

The present invention solves this task by providing a latching mechanism which locks a coke oven chamber door against the coke oven chamber wall simultaneously to the procedure of opening or closing. The latching mechanism is actuated by the auxiliary structure of an auxiliary frame which is mounted on the front side of a door and which is freely movable in vertical direction, with some restrictions. The limitation in downward direction is given by so-called retainer cams which the auxiliary frame rests on when the door is in closed position. The limitation in upward direction is given by so-called limit stop cams which are not reached until the auxiliary frame is pulled up. A lateral movement of the auxiliary frame is prevented by retainer clamps. When the auxiliary frame is pulled-up, it unlatches the latching mechanism. When the auxiliary frame has hit against the limit stop cams, it pulls the door against the limit stop cams into the opened position.

The actual latching mechanism is comprised of levers rotationally movable on an axis vertically to the oven wall encompassing the coke oven chamber door, wherein said levers are connected to latches which can be moved in translatory movement alongside the coke oven chamber wall encompassing the door. The rotation of levers is triggered by pulling-up the auxiliary frame, whereby the latches freely movable in translatory movement are pulled out from the latch bearing, thus unlatching the door. In an advantageous embodiment of the present invention, the translatorily freely movable latch is resiliently retained in the latch bars so as to haul it back into the latching position when closing the door.

By way of a simultaneous opening and unlatching or closing and latching, the latching procedure can be well automatized. The latch is released by the traction force of the opening mechanism. With an automated device for opening and closing of coke oven chambers, this is then executed for the latching procedure, too. The device as described hereinabove is insensitive to contamination, because the essential part of the latching unit is mounted on the front side of a coke oven chamber door.

On the coke oven chamber wall side, the latching unit preferably engages into so-called latch take-up bearings. These may be so mounted that the coke oven chamber door closes flush to the coke oven chamber wall. For this purpose, the coke oven chamber door is opened in form of a semicircle from the coke oven chamber door by levers fastened to the coke oven chamber door. As a rule, however, the door structure protrudes from the coke oven chamber structure. Retainer bars are then mounted in the coke oven chamber wall which allow for taking-up the latches in a position located in front of the coke oven chamber wall. This is especially recommendable if the coke oven chamber door is comprised of a plug with a front-mounted retainer device so that the coke oven chamber door device is spatially projected from the coke oven chamber wall. A latching of virtually any door construction style for horizontal coke oven chambers is thereby feasible by implementing the inventive latching device.

Claimed in particular is a device for latching of doors, door bodies and door jambs of horizontal coke oven chambers, wherein

- the doors, door bodies and door jambs are movably suspended in vertical direction, and
- the doors, door bodies and door jambs mechanically connected by a rope, a chain or a lever to a device for vertically-directed pulling and relieving, and
- the doors, door bodies or door jambs are equipped with latches locking the coke oven chamber in horizontal and vertical direction alongside the oven chamber walls encompassing the door, and which are characterized in that

- the doors, door bodies or door jambs are comprised of an auxiliary frame on the side averted from the coke oven chamber, said auxiliary frame being guided by clamps running on the oven chamber door and being suspended in restricted vertical mobility versus the doors, door body or door jamb, and
- the auxiliary frame is comprised of at least one actuating cam per side on the vertical exterior side, and
- a lever being rotationally movable by an axis directed orthogonally to the oven in the direction of running of the actuating cam, and
- a lever being translatorily movable alongside the coke oven chamber wall in outward direction from the door is connected to the rotationally movable lever which locks the door against the coke oven chamber wall by snapping it into a take-up device in the coke oven chamber wall, and
- limit stop cams are mounted on the door side averted from the coke oven chamber above the auxiliary frame, and that the auxiliary frame arrests on said limit stop cams in outward movement after having covered a distinct vertical path.

To implement the inventive device, the auxiliary frame should preferably have a rectangular shape. However, it is also feasible to configure it in a circular or quadratic shape. Finally, any shape is considered suitable that allows for providing a stable frame device to apply the inventive purpose. In an embodiment of the invention, the latch in door-outward direction latches the coke oven chamber door horizontally towards the side alongside the coke oven chamber wall. To allow for an autonomous latching when closing and lowering the auxiliary frame, the locking bar resting in the coke oven chamber door is preferably supported in a resilient facility. Thereby, the latch moves back into the locking home position after the backward movement of the rotationally freely movable levers. It is also possible to offset this by a plurality of actuating cams which move the rotating lever back. As a rule, however, this involves additional expenditure on design and turns out to be less reliable.

The present invention advantageously allows for mounting two actuating cams with the latching units associated therewith per coke oven door chamber side. Depending on requirements, even one actuating cam with the latching units associated therewith can be sufficient. But after all any arbitrary number of actuating cams with the latching units associated therewith per coke oven chamber door side could be used. The latching devices can lock the coke oven chamber door in arbitrary directions. Hence, it is possible to let the latches lock the door of the coke oven chamber laterally from the door. But it is also possible to let the latches lock the door upwardly from the door. Finally, the latches directed from the door can lock it in any arbitrary direction. Suitable latch take-up devices are arranged on the coke oven chamber wall to take-up the latches.

In an embodiment of the present invention, the latch take-up bearings serving as a take-up device for the latches are directly arranged on the coke oven chamber wall. For the majority of door construction types of coke oven chambers, however, it is advantageous for the latch take-up device to be arranged in a lever or in a bar which is positioned in front of the coke oven chamber wall. Thereby, even door construction types comprised of a more sophisticated plug configuration can be latched by the inventive latching device.

As a matter of fact, doors equipped with the inventive latching device can be of any arbitrary kind. To ensure the pressure-tightest possible closure of the carbonization process towards the environment, structures are usually arranged between coke oven door and coke oven chamber wall that constitute a gas barrier to the door transition. These are membranes or so-called sealing edge frames. These devices are usually made of a metallic material and rest on a suitable sealing edge in the oven chamber frame.

The membranes are usually elastic and pressed via appropriate compression elements, for example springs, against the coke oven chamber wall. Any deformation becoming evident in the oven chamber wall and door throughout the operating time and otherwise entailing substantial emissions can thus be counteracted. The membranes or sealing edge devices can be contained in doors or door devices of coke oven chambers which are latched by the inventive device.

An example for a suitable door device for coke oven chambers equipped with the inventive latching device is described in EP 724007 B1 Accordingly, a plug locks the coking chamber opening of a horizontal coke oven chamber. The plug itself is mounted on a backing plate which in turn is mounted on a mounting plate forming the door jamb of a horizontal coke oven chamber. The backing plate and the mounting plate are kept at certain spacing by the use of compression bolts. As a result, the heat impact on the mounting plate can be kept low while deformations of the coke oven chamber frame are adapted on the other hand. The sealing edge frame which seals the door gap between door plug and coke oven chamber frame is charged with pressure through adjustable spring compression elements that are connected to a frame of the door body. For example, the inventive device can be mounted on the mounting plate. Thereby, the entire door device can be locked on the coke oven chamber wall. In an embodiment of the invention, the coke oven chamber door is comprised of a coke oven chamber door jamb having a heat-resistant oven-inwardly directed plug which presses the coke oven batch into the coke oven chamber.

The coke oven chamber door locked with the inventive latching mechanism can be of any arbitrary kind. The inventive latching device is also suitable for coke oven chamber doors which are sealed with a sealing material between coke oven chamber door and coke oven chamber. Examples for suitable materials are ceramic wool or glass wool. The door or the coke oven chambers may also be coated. Finally, the coke oven chamber door and coke oven chamber can additionally be pressed by a compressive device like a helical thread or a resilient device onto the coke oven chamber wall in order to afford the inventively latched door higher compression onto the coke oven chamber opening.

In one embodiment of the present invention, the coke oven chamber door is guided on rails for opening and closing. In this case, the coke oven chamber door is slightly larger than the opening behind so that it can be guided on notches or dents serving as rails. In another embodiment of the present invention, the door is fastened with articulated rods to the coke oven chamber wall and thus moved into the opened position. The door is then vertically pulled-up describing a semicircular movement leading away from the oven so that it is moved into a position of rest above the coke oven opening. It is also possible to fasten the articulated rods above or below the door so as to open the door to the side. The opening mechanism can be of any arbitrary kind in order to be able to be locked by the inventive latching device. Thereby, even doors positioned in the coke oven chamber opening can be opened by the inventive device.

In another embodiment of the present invention, the coke oven door is comprised of a device for arresting it. As a result, the coke oven door can be arrested in the open or closed position. In this manner, the latches are additionally relieved. The device for arresting may be of any arbitrary kind and may be positioned at any arbitrary position on the coke oven door. The rectangular auxiliary frame, too, may be equipped with an arresting device. As a result, the door can be locked without actuating the latching mechanism. In another embodiment of the invention, the vertical, door-outwardly directed sides are comprised of two actuating cams per side with the same number of levers rotationally movable by axes directed orthogonally to the oven in the running direction of actuating cams and comprised of door-outwardly directed latches connected thereto moving in translatory movement along the coke oven chamber wall.

Also claimed is a method for latching a door, a door body or a door jamb of a horizontal coke oven chamber battery, characterized in that

- an auxiliary frame mounted on the front side of the coke oven chamber door initially starts moving when the door device is opened by the vertical traction via a mechanical traction connection, and
- by way of lateral actuating cams mounted on the outside this auxiliary frame moves a rotationally movable lever by an axis orthogonally to the coke oven chamber and this rotationally movable level presses a latch translatorily movable longitudinally to the coke oven chamber wall encompassing the door towards the inside, thus unlatching the coke oven chamber door, and
- the auxiliary frame while moving vertically upwards hits against limit stop cams firmly connected to the coke oven chamber door body and moving the entire door device upwards, and
- the door device glides back into the door frame of the coke oven chamber when the vertical traction force is relieved, and
- the auxiliary frame falls back into the catch of the coke oven chamber door front side while moving the rotationally movable lever backwards and that by means of this rotational movement the translatorily movable latch again latches the coke oven chamber door against the coke oven chamber wall.

During the carbonization process, the latching device can be opened or closed at any arbitrary moment. As a rule, the latching mechanism is actuated if the coke oven door is opened for cleaning or charging after a carbonization cycle. This is realized by exerting a traction force on the chains fastened to the coke oven chamber door or on the rope tackle. The traction force on the doors of the coke oven chambers can be arbitrarily generated. It is also feasible to generate it by a hydraulic cylinder or a hydraulic lever. But it is also possible to exert the traction force by an electrically or manually operated lever. Also conceivable are tooth gear driven facilities or a mechanism driven by steam or gas. All devices for generating a traction force are conceivable for actuating the inventive latching device. In an embodiment of the method of the invention, the coke oven chamber door is moved in vertical direction by a hydraulically driven rope tackle.

The inventive method for latching is suitable both for coke oven chambers of the "Heat Recovery" type, "Non-Recovery" type and for coke oven chambers of the "conventional" type. This method is suitable in particular for ovens of the "Heat Recovery" type, in particular, which only generate minor emissions of by-products.

The inventive method and, consequently, the device operated by applying this method offer the advantage of a reliably latching mechanism for coke oven chamber doors. The inventive device requires no extensive latching mechanisms located upstream, it works in a manner economizing on space and it increases the weight of the door structure of a coke oven chamber just slightly. It is kind on maintenance and operation. It is insensitive to encrustation and contamination and it requires no extensive alterations in running operation. The inventive device seals the interior space of a coke oven chamber in a pressure-proof and tight manner if suitable sealing edge frames or membranes are utilized. Moreover, the inventive device for latching allows for easy automation of the method for latching of coke oven chambers. If an appropriate control facility is applied, the latching mechanism of each individual coke oven chamber of a coke oven battery or a coke oven bank can be triggered via the actuation of the opening.

The inventive configuration of a device for latching of a coke oven chamber is elucidated more closely by way of two drawings, with the inventive method not being restricted to these embodiments.

DETAILED DESCRIPTION OF THE INVENTION

Figure 1:
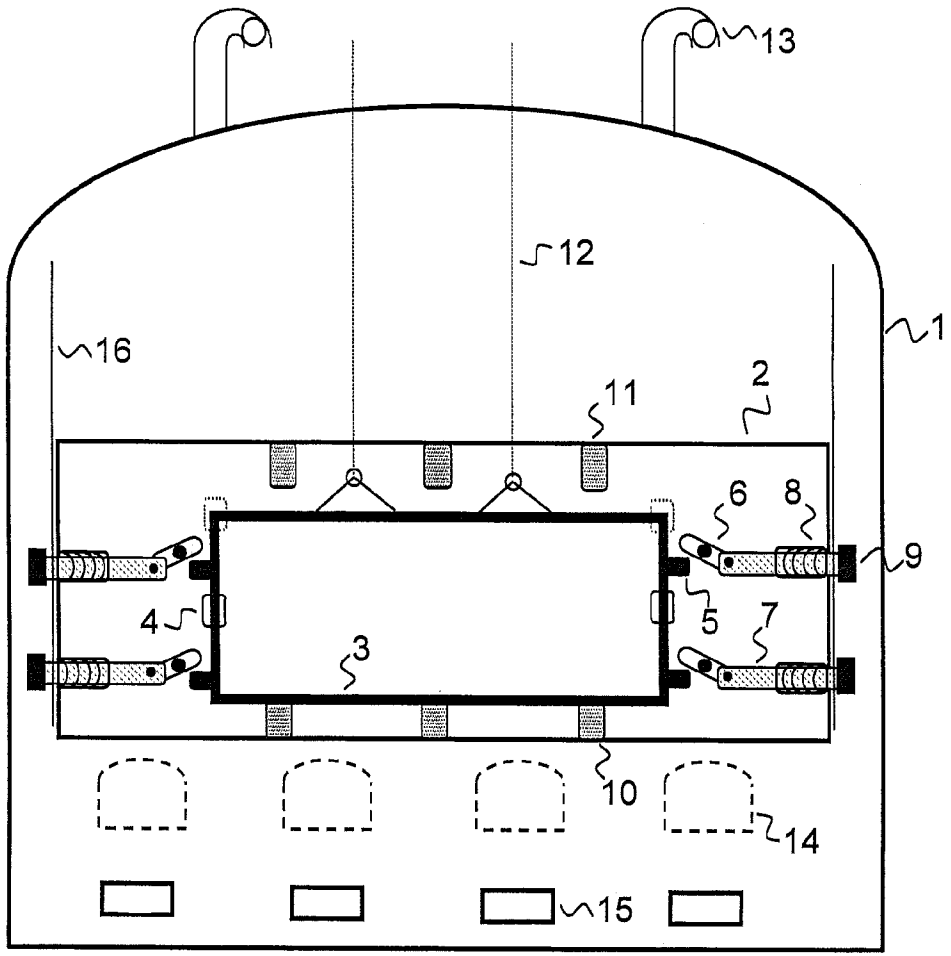
FIG. 1 shows a horizontal coke oven chamber with the inventive device for latching in a front view while the coke oven door is closed.

FIG. 1 shows a horizontal coke oven chamber with the inventive device for latching in a front view whilst the coke oven chamber door is closed. The coke oven chamber (1) is closed with a coke oven chamber door (2) with a coke oven door jamb. Situated on the coke oven chamber door (2) is an auxiliary frame (3) which is movably fixed by clamps (4) or other suitable devices on the coke oven chamber door. Mounted at the lateral wall of the frame are two actuating cams (5) per side which during the upward movement hit against levers (6) which are movable by axes orthogonally to the oven. These levers (6) in turn are connected to latches (7) translatorily movable in longitudinal direction to the coke oven chamber wall encompassing the door. The latches can seat in spring-resilient bearings (8). The latches engage into gripping latch take-up bearings (9) which are mounted on the coke oven chamber wall. In downward direction, the auxiliary frame (3) rests on supporting cams (10) which are fastened to the coke oven chamber door (2). Limit stop cams (11) are firmly mounted on the upper part of the coke oven chamber door, with the auxiliary frame (3) hitting against these limit stop cams whilst moving upwardly. The upward movement can be realized by applying a traction device like the one of a chain or rope or lever (12). A device for venting the oven (13) is arranged on the top of the coke oven chambers. Arranged under the coke oven chamber doors are secondary air soles (14) and openings, too, for the intake of air (15). For opening, the coke oven chamber door is supported on a load-carrying rail (16).

Figure 2:
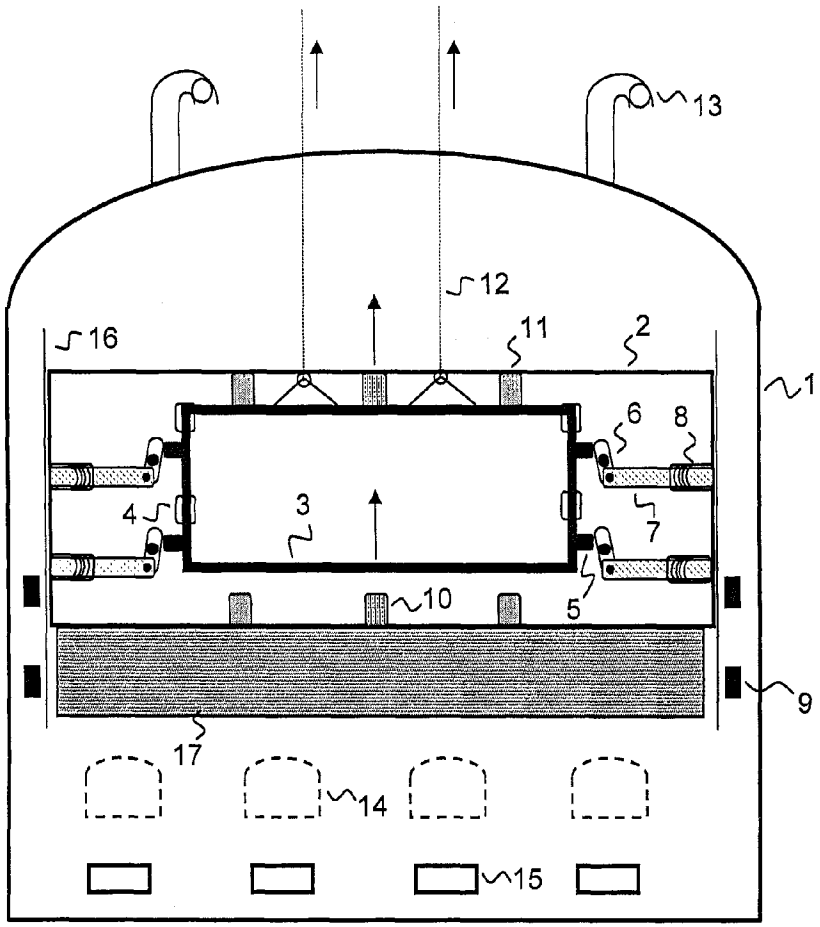
FIG. 2 shows a horizontal coke oven chamber with the inventive device for latching in a front view while the coke oven door is opened.

FIG. 2 shows a horizontal coke oven chamber with the inventive device for latching in a front view whilst the coke oven chamber door is opened. A coke oven chamber door (2) mounted to the coke oven chamber (1) is comprised of an auxiliary frame (3) which is pulled-up via ropes or chains (12). During this procedure it hits against the limit stop cams (11). These transmit the vertical traction force to the coke oven chamber door (2) which is thereby opened and releases the coke oven chamber batch (17). The auxiliary frame (3) is guided in clamps (4) and fixed on the coke oven chamber door (2). During the upward movement, the actuating cams (5) fastened to the auxiliary frame (3) hit against levers (6) which are movable by axes orthogonally to the oven. These actuate the latches (7) which press the resilient bearings (8) and are pulled out from the take-up devices (9). The coke oven chamber door (2) is thereby opened and releases the coke cake (17). During this procedure, the coke oven chamber door (2) is guided on a rail (16).

Figure 3:
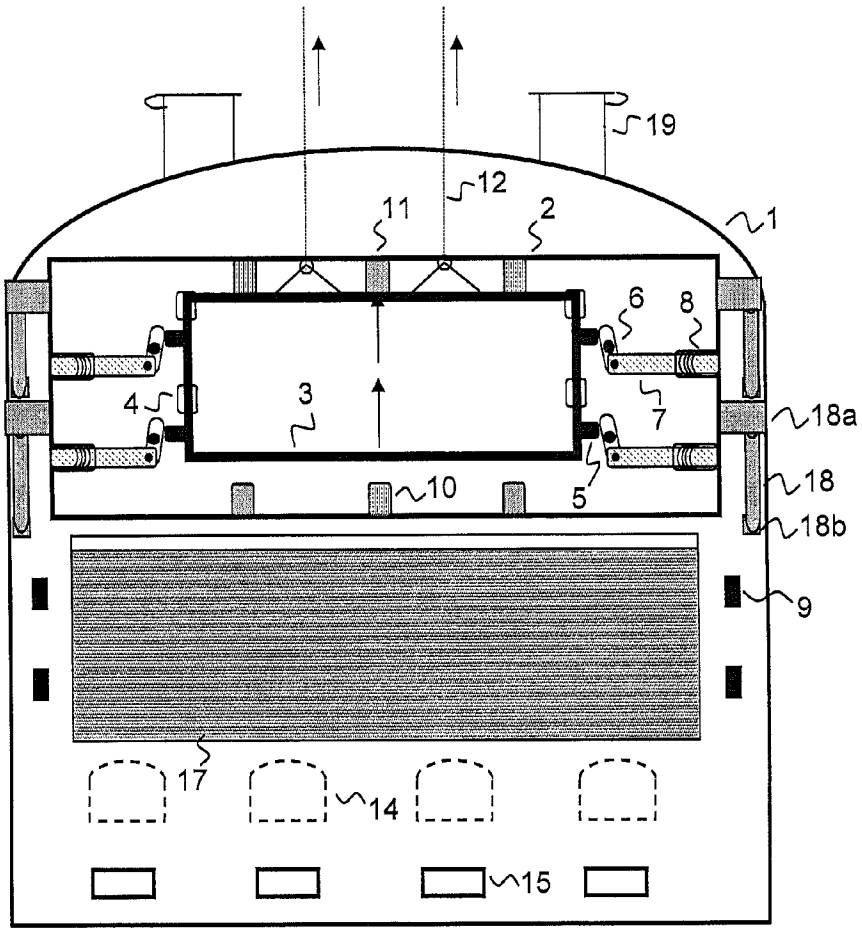
FIG. 3 shows a horizontal coke oven chamber with the inventive device for latching in a front view while the coke oven chamber door id completely opened.

FIG. 3 shows a horizontal coke oven chamber with the inventive device for latching in a front view whilst the coke oven chamber door is completely opened. A coke oven chamber door (2) mounted to the coke oven chamber (1) is comprised of an auxiliary frame (3) which has been pulled-up via ropes or chains (12). The coke oven chamber door is fastened via articulated rods (18) to the door (18*a*) and to the coke oven chamber wall (18*b*) and for opening it has been moved away from the oven chamber wall in a semicircular movement. Openings (19) for charging the coke oven chambers are located on the oven top.

Figure 4:
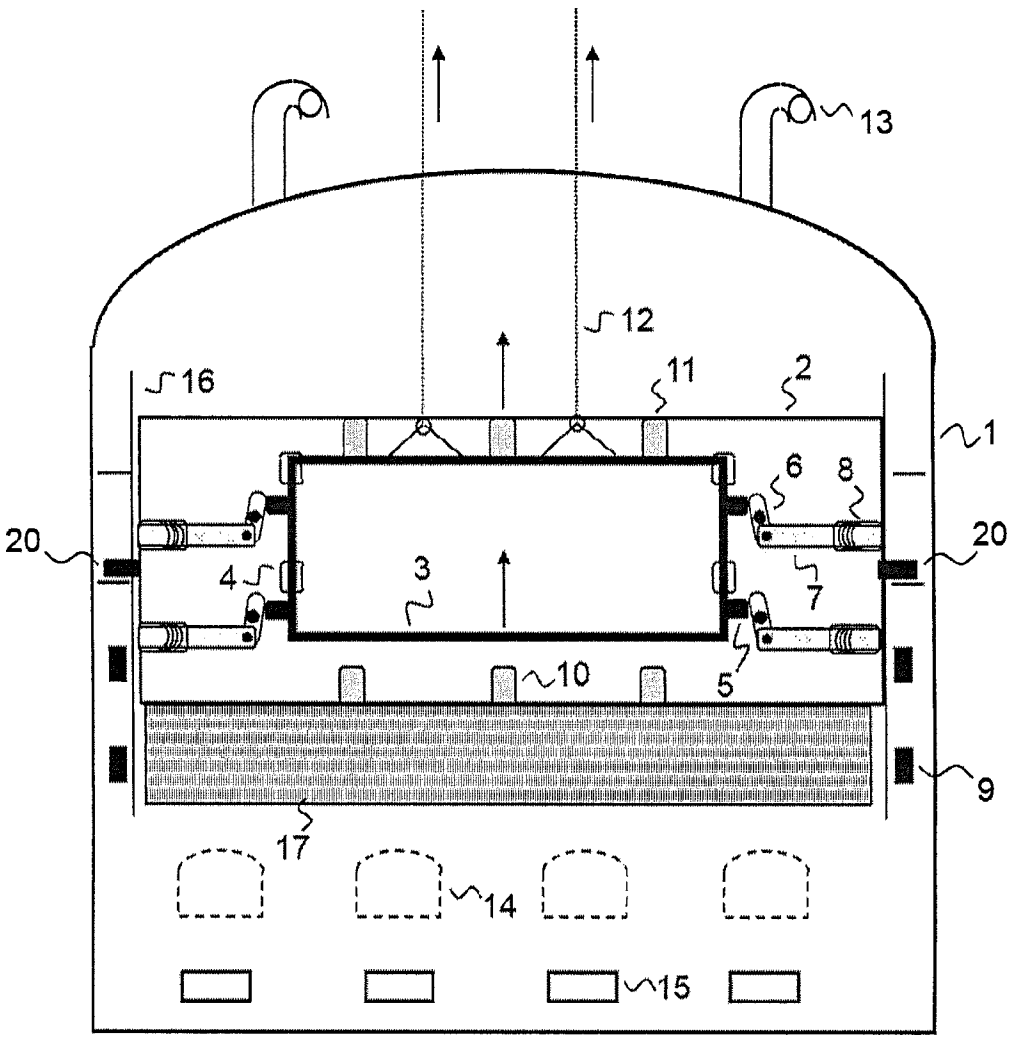
FIG. 4 shows a similar view to FIG. 2 showing additional detail.

FIG. 4 shows a horizontal coke oven chamber with a coke oven chamber door jamb situated on the coke oven chamber door (2) on the side averted from the coke oven chamber (1), being comprised of a device for arresting (20) the coke oven chamber door (2) in the open or closed position.

Figure 5:
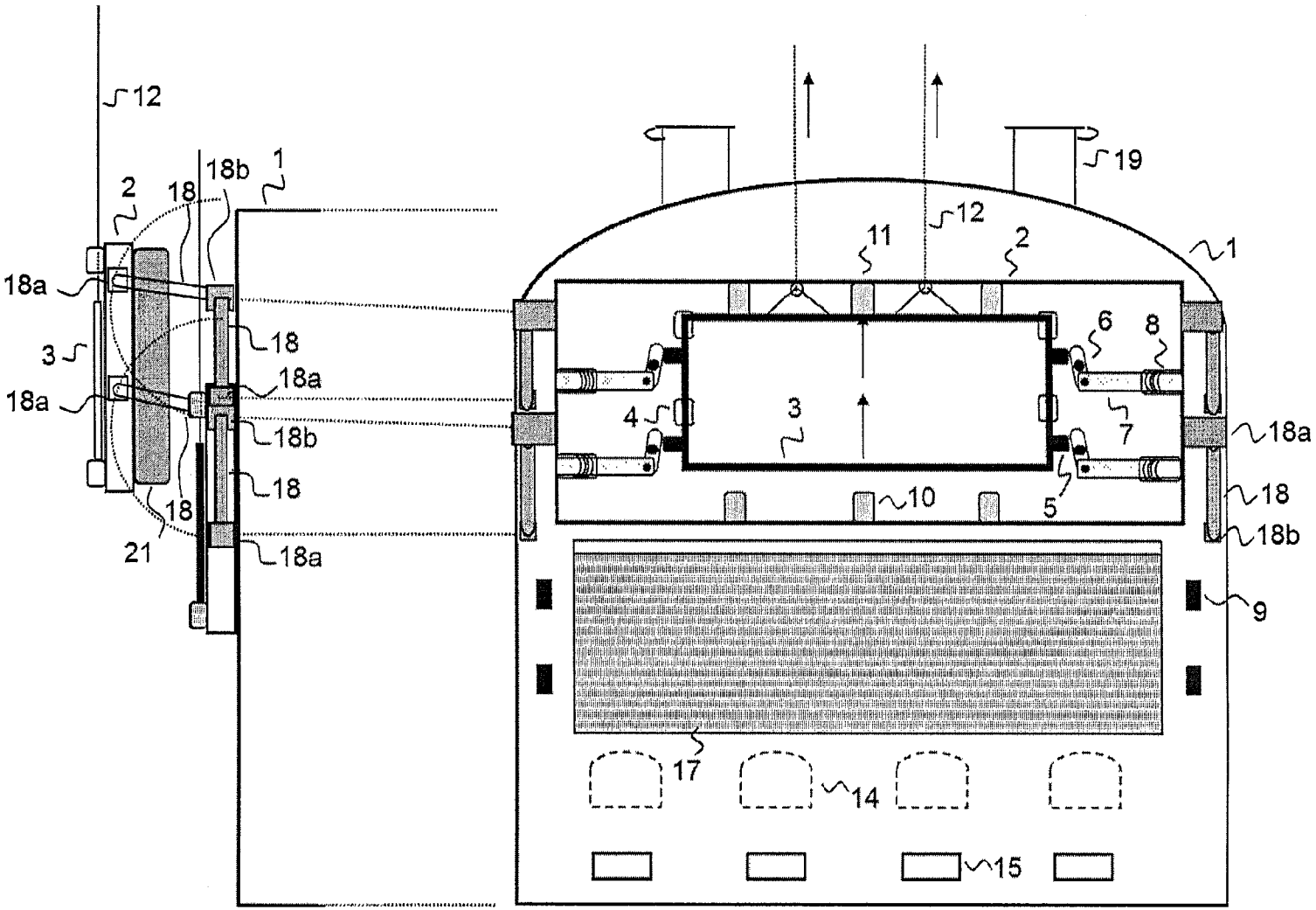
FIG. 5 shows a similar view to FIG. 3 showing additional detail.

FIG.5 is identical to FIG.3 and gives an adumbrated side view of the coke oven chamber door (2). FIG. 5 shows a horizontal coke oven chamber with the coke oven chamber door (2) being comprised of a coke oven chamber door jamb having a heat-resistant oven-inwardly directed plug (21) as a coke oven chamber door body which presses the coke oven batch (17) into the coke oven chamber (1).

LIST OF REFERENCE SYMBOLS

1 Horizontal coke oven chamber
2 Coke oven chamber door
3 Auxiliary frame
4 Guiding clamps for auxiliary frame
5 Actuating cams
6 Rotationally movable levers
7 Translatorily movable levers
8 Resilient bearings
9 Latch take-up bearings
10 Take-up cams
11 Limit stop cams

12 Rope tackle or chain
13 Vent opening in coke oven chamber top
14 Secondary air sole
15 Vent opening in coke oven chamber sole
16 Guide rail for coke oven chamber door
17 Coke oven chamber opening with a coke cake resting therein
18 Articulated rods
18*a* Articulated rod fastening to the door
18*b* Articulated rod fastening to the coke oven chamber wall
19 Openings in coke oven chamber top for charging
20 Device for arresting
21 Plug

The invention claimed is:

1. A device for latching of a coke oven chamber door of horizontal coke oven chambers with external coke oven chamber walls, wherein the coke oven chamber door is movably suspended in a vertical direction;

the coke oven chamber door is mechanically connected by a mechanical traction connection to a device for vertically-directed pulling and relieving; and the coke oven chamber door is equipped with at least one latch a locking the coke oven chamber in horizontal and vertical direction alongside the external coke oven chamber walls encompassing the coke oven chamber door; wherein the coke oven chamber door is comprised of an auxiliary frame on the side averted from the coke oven chamber, said auxiliary frame being guided by clamps riding on the coke oven chamber door and being suspended in restricted vertical mobility versus the coke oven chamber door;

the auxiliary frame is comprised of at least one actuating cam per side on the vertical exterior side;

a lever is rotationally movable by an axis directed orthogonally to the oven in the direction of running of the actuating cam;

the latch being translatorily movable alongside the external coke oven chamber wall in outward direction from the coke oven chamber door is connected to the rotationally movable lever and locks the coke oven chamber door against the external coke oven chamber wall by snapping it into a take-up device in the external coke oven chamber wall; and limit stop cams are mounted on the coke oven chamber door side averted from the oven above the auxiliary frame in the coke oven chamber door, and that the auxiliary frame arrests on said limit stop cams in outward movement after having covered a distinct vertical path.

2. The device for latching of a coke oven chamber door of horizontal coke oven chambers according to claim 1, wherein a latch take-up bearing for the latch is mounted on a lever or a rod mounted to the external coke oven chamber wall and positioning the latch take-up device in front of the external coke oven chamber wall.

3. The device for latching of a coke oven chamber door of horizontal coke oven chambers according to claim 1, wherein the auxiliary frame is configured in a rectangular shape.

4. The device for latching of a coke oven chamber door of horizontal coke oven chambers according to claim 1, wherein the at least one latch in door-outward direction latches the coke oven chamber door horizontally towards the side alongside the external coke oven chamber wall.

5. The device for latching of a coke oven chamber door of horizontal coke oven chambers according to claim 1, wherein the coke oven chamber door-outwardly directed translatorily freely movable latch are provided with a resilient facility by which the latch can be moved back into a position latching against the coke oven chamber door.

6. The device for latching of a coke oven chamber door of horizontal coke oven chambers according to claim 1, wherein the coke oven chamber latching coke oven chamber door is equipped with an articulated rod connected to the external coke oven chamber wall, said articulated rod allowing for a semicircular movement away from the external coke oven chamber door while moving vertically upward.

7. The device for latching of a coke oven chamber door of horizontal coke oven chambers according to claim 1, wherein a coke oven chamber door jamb is situated on the coke oven chamber door on the side averted from the coke oven chamber and is comprised of a device for arresting the coke oven chamber door in the open or closed position.

8. The device for latching of a coke oven chamber door of horizontal coke oven chambers according to claim 1, wherein the vertical, door-outwardly directed sides are comprised of two actuating cams per side with the same number of levers rotationally movable by axes directed orthogonally to the oven in the running direction of actuating cams and comprised of door-outwardly directed latches connected thereto moving in translatory movement along the external coke oven chamber wall.

9. The device for latching of a coke oven chamber door of horizontal coke oven chambers according to claim 1, wherein the coke oven chamber door has a heat-resistant oven-inwardly directed plug which presses the coke oven batch into the coke oven chamber.

10. The device for latching of a coke oven chamber door of horizontal coke oven chambers according to claim 1, wherein the coke oven chamber door further comprises a coke oven chamber door body and a coke oven chamber door jamb.

11. A method for opening and closing a coke oven chamber door of a horizontal coke oven chamber, wherein an auxiliary frame mounted on the front side of the coke oven chamber door initially starts moving when the coke oven chamber door device is opened by a vertical traction via a mechanical traction connection;

by way of lateral actuating cams mounted on the outside, this auxiliary frame moves a lever rotationally movable by an axis orthogonally to the coke oven chamber and this rotationally movable lever presses a latch translatorily movable longitudinally to the external coke oven chamber wall encompassing the coke oven chamber door towards the inside, thus unlatching the coke oven chamber door;

the auxiliary frame while moving vertically upwards hits against limit stop cams firmly connected to the coke oven chamber door and moving the entire coke oven chamber door upwards;

the coke oven chamber door glides back into a front side of the coke oven chamber door when the vertical traction force is relieved; and the auxiliary frame falls back onto supporting cams of the coke oven chamber door front side while moving the rotationally movable lever backwards and that by means of this rotational movement the translatorily movable latch again latches the coke oven chamber door against the external coke oven chamber wall.

12. The method for opening and closing a coke oven chamber door of a horizontal coke oven chamber according to claim 11, wherein the coke oven chamber door is moved in a vertical direction by a hydraulically driven rope tackle.

* * * * *

UNITED STATES PATENT AND TRADEMARK OFFICE

CERTIFICATE OF CORRECTION

PATENT NO. : 8,720,430 B2
APPLICATION NO. : 12/734831
DATED : May 13, 2014
INVENTOR(S) : Schuecker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 960 days.

Signed and Sealed this
Twenty-ninth Day of September, 2015

Michelle K. Lee

Michelle K. Lee
*Director of the United States Patent and Trademark Office*